United States Patent [19]

Salomon

[11] 4,049,290

[45] Sept. 20, 1977

[54] SKI-BINDING

[75] Inventor: Georges Pierre Joseph Salomon, Annecy, France

[73] Assignee: Establissements Francois Salomon et Fils, Annecy, France

[21] Appl. No.: 611,419

[22] Filed: Sept. 8, 1975

[30] Foreign Application Priority Data

Sept. 11, 1974 France ..... 74.30734

[51] Int. Cl.[2] ..... A63C 9/08

[52] U.S. Cl. ..... 280/613; 280/624

[58] Field of Search ..... 280/624, 625, 635, 611, 280/613, 614, 616

[56] References Cited

U.S. PATENT DOCUMENTS

| | | | |
|---|---|---|---|
| 2,173,846 | 9/1939 | Kelley | 280/625 |
| 2,228,215 | 1/1941 | Jauslin | 280/614 |
| 3,271,040 | 9/1966 | Spademan | 280/624 |
| 3,606,370 | 9/1971 | Spademan | 280/624 |
| 3,740,064 | 6/1973 | Weg | 280/624 |
| 3,869,136 | 3/1975 | Jackson | 280/613 |

FOREIGN PATENT DOCUMENTS

| | | | |
|---|---|---|---|
| 236,147 | 7/1911 | Germany | 280/636 |

*Primary Examiner*—Joseph F. Peters, Jr.
*Assistant Examiner*—Milton L. Smith

[57] ABSTRACT

A ski binding consists of: a baseplate mounted on the ski; two arms articulated in relation to the baseplate, arranged symmetrically in relation to the longitudinal axis of the ski, and each comprising a retaining jaw; a resilient element actuating the jaws on the articulated arms through a transmitting element; in relation to the baseplate, the articulated arms rotate about a vertical axis and move longitudinally; the present binding has been designed for the express purpose of restricting the intensity of the frictional forces between parts moving in relation to each other.

7 Claims, 6 Drawing Figures

1
5
14
15
16
17
42
13
9
3
6
8
7
2
11
10
20
12
19
6
7
6
36
32
24
18
37
3
2
4
21

I
1
14
8
7
6
2
2
F
26
3
30
19
28
29
27
31
8
24
7
25
23
22
2
2
G2
G1
I

SKI-BINDING

The present invention relates to a ski-boot safety binding that comprises retaining jaws located on each side of the ski and cooperating with the lateral edges of the sole of the boot, or with a part fitting under the sole of the boot.

Bindings of this kind are known. German Utility Model 1,851,535, filed on Mar. 17, 1962, and published May 10, 1962 describes a binding designed to hold the boot to the ski by its edges, by means of a separate part secured to the sole of the boot; this binding is known to provide a safety release under a vertical load. Bindings of this kind have the remarkable advantage of leaving the boot entirely free after the release, so that the boot may continue to travel in the longitudinal direction of the ski under the action of inertia. It will be observed that this does not apply to safety bindings equipped with retaining elements located in front of or behind the boot; in this case, the boot cannot advance freely, even after the release, since it comes up against the front stop. At times, this causes serious accidents, especially in the case of violent impacts which throw the skier forwards.

Numerous forms of bindings comprising retaining elements located on each side of the ski have been proposed. Among the more recent are those in which the boot-retaining jaws are carried on hinged arms adapted to rotate about an axis which is stationary in relation to the baseplate. Bindings of this kind are described, more particularly in French Pat. No. 2,021,337 filed on Oct. 21, 1969 and published July 17, 1970. In the binding described in this patent, the articulated arms are applied, through a transmitting element, to the sole of the boot or to a separate part under the sole of the boot; the transmitting element cooperates with the arms by means of a system of ramps.

A binding of this kind has certain disadvantages; for instance, it will be observed that:

on the one hand, the opening between the articulated arms is restricted by the length of the ramps and by the body of the binding;

on the other hand, there is considerable friction between the ramps and between the arms and the fixed pivot;

finally, the torque varies as a function of the location of the centre of rotation of the boot, which is not defined.

This produces poor resilient return of the binding prior to release.

It is an object of the present invention, which relates to a binding comprising lateral jaws mounted upon an articulated arm, to overcome the above-mentioned disadvantages of these bindings. To this end, the ski-boot safety binding according to the invention comprises:

a baseplate mounted on the ski;

two arms articulated in relation to the baseplate arranged symmetrically in relation to the longitudinal axis of the ski and each comprising a boot-retaining jaw extending over the upper plane of the baseplate and cooperating with the lateral edge of the sole of the boot, or with a part fitted under the sole of the boot;

a resilient element, mounted on the baseplate, which, through a transmitting element, applies the jaws on the articulated arms to the sole of the boot, or to the part fitted under the sole.

Furthermore, according to an original characteristic essential to the invention, the articulated arms simultaneously rotate about a vertical axis and move longitudinally in relation to the baseplate. The essential characteristic of the invention makes it possible to obtain a particularly compact binding, having articulated arms with an opening angle substantially wider than that obtainable with existing bindings. This means that, after the release and, more particularly, under the action of a lateral load, the boot may continue to pivot, without being prematurely impeded by the jaws, since the latter open widely. Moreover, during this phase of the operation of the binding after the release, the opening of the arms is limited only by the resilient element, which therefore progressively damps the rotation of the boot. It should be noted that this is not the case with existing bindings, in which the extent to which the arms open is drastically restricted by the body. Furthermore, this essential characteristic according to the invention reduces friction between parts moving in relation to each other — the reason for this will be given in greater detail hereinafter.

Moreover, according to a complementary characteristic of the invention:

on the one hand, the transmitting element is adapted to move longitudinally in relation to the baseplate; and on the other hand, each articulated arm is adapted to rotate about a vertical axis which is fixed in relation to the transmitting element and which pivots slidingly on a supporting point which is fixed in relation to the baseplate; each arm comprises a ramp on which the supporting point on the baseplate slides.

It is emphasized that, in the binding according to the invention, sliding and rotating take place at the same location, i.e. the supporting point which is fixed in relation to the baseplate. As a result of this — and this result is conventional in the mechanics of friction between moving parts — frictional forces are considerably reduced. This is quite an advantage since, for many reasons, unwanted or random friction is one of the main problems to be overcome in designing an efficient safety binding, i.e. one which is reliable under all circumstances, since the major part of the energy provided by the string can then be applied to the boot.

According to another object of the invention, the slide-ramp is preferably located on the articulated arm, between the boot-retaining jaw and the vertical axis of rotation fixed in relation to the transmitting element. Correlatively, the transmitting element is caused to move longitudinally by the resilient element, in a direction running from the jaw to the supporting point on the baseplate.

According to another secondary characteristic of the invention, and in order to facilitate the use of the binding, the binding also comprises a voluntary-ski-removal device consisting of a lever allowing the skier to move the transmitting element longitudinally in order to release the jaws.

The present binding according to the invention is particularly suitable for attachment to a boot in which one end, especially the heel, has a recess which, after the release, allows the retaining jaws to pass under the sole of the boot, when the boot pivots under a lateral load. A boot of this kind is described in French Patent Application 74,29616 filed on Aug. 30, 1974 and published Mar. 27, 1976 in the name of S. A. "ETABLISSEMENTS FRANCOIS SALOMON et FILS" and entitled: "A ski boot designed to move freely, after the release, in a binding comprising a lateral retaining jaw", incorporated herein by way of reference.

A description will be now given, as a non-restricting example, of an embodiment of a binding according to the invention, in conjunction with the drawing attached hereto, wherein.

Figure 1:
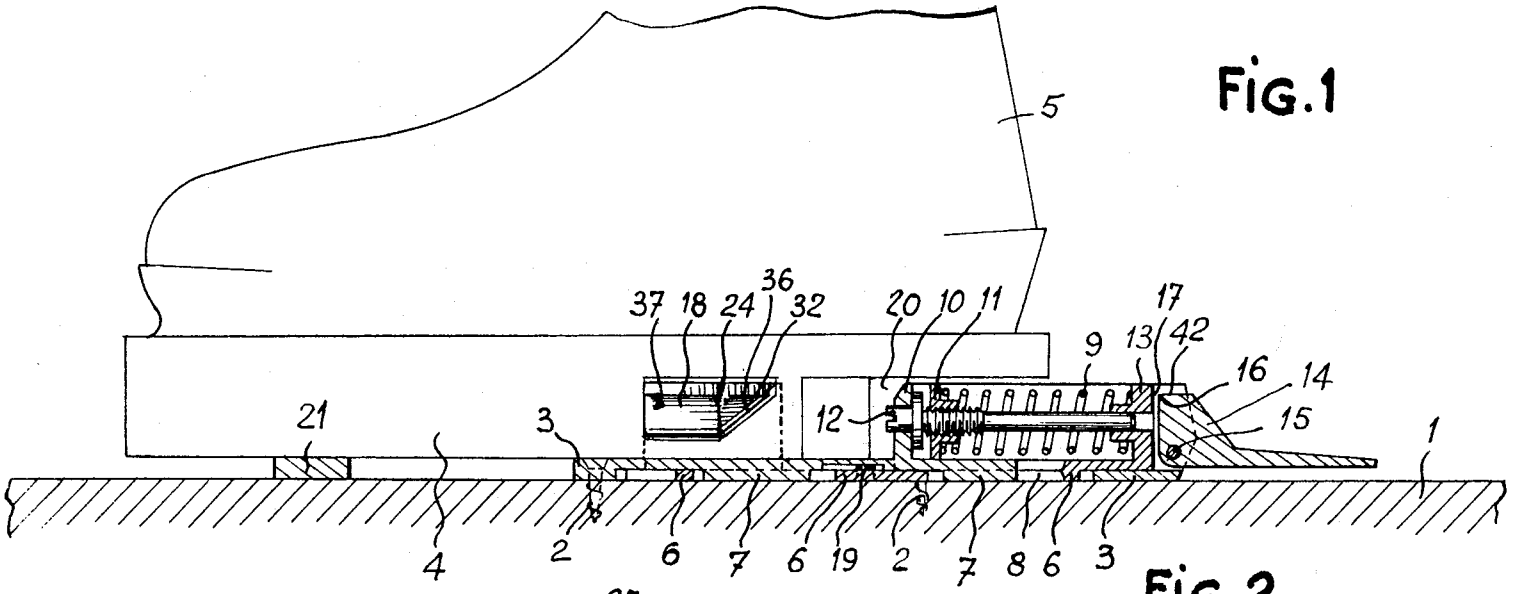
FIG. 1 shows a side elevation, in longitudinal section of a binding according to the invention; the jaws are omitted in order to show the housing in the boot in which they fit.
Figure 2:
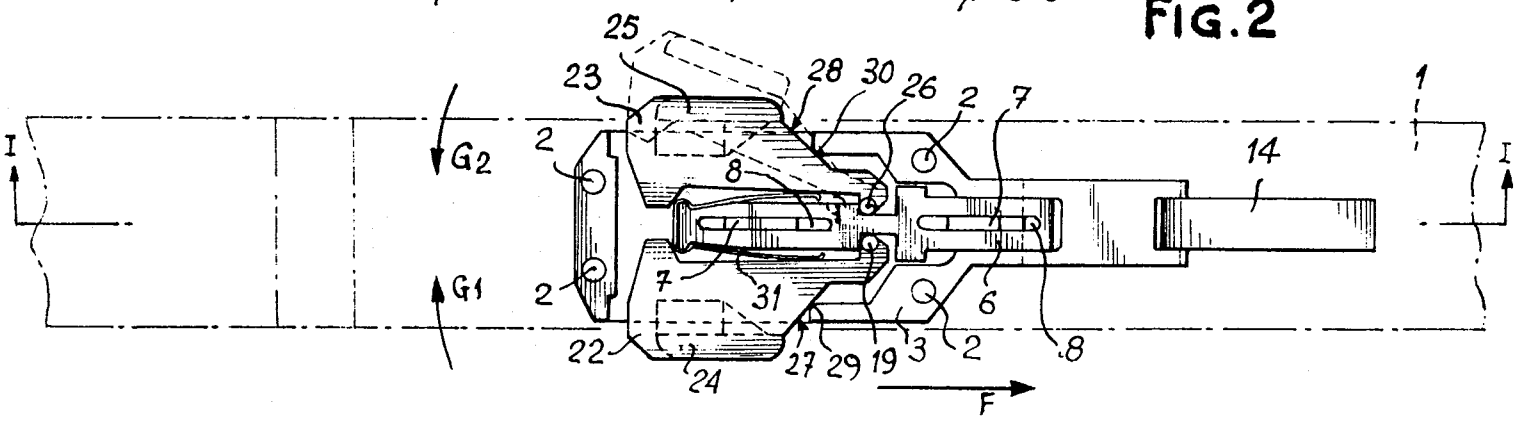
FIG. 2 is a view from below of the binding illustrated in FIG. 1, being assumed that the ski is transparent.

FIG. 1 shows a longitudinal section of a binding according to the invention along the line I—I of FIG. 2. Attached to ski 1, by means of screws such as 2, is a baseplate 3 running partly under the heel of sole 4 of a boot 5. A transmitting element 6, adapted to move longitudinally, is guided by any suitable means, more particularly by shoulders 7 integral with the baseplate and sliding in slots 8 provided for the purpose in transmitting element 6.

The transmitting element is actuated by a resilient element in the form of a spring 9 arranged along the longitudinal axis of the ski;

one end of this spring bears against a shoulder 13 integral with the transmitting element;

the other end of the spring bears against a shoulder 10, integral with baseplate 3, through a threaded sleeve 11 screwed to a threaded rod 12. Since sleeve 11 is secured against rotation, the skier may adjust the tension of the spring by turning threaded rod 12.

Hinged to baseplate 3 is a lever 14 which pivots about a pin 15 mounted to the baseplate. This lever has a nose (or lug) cooperating with a ramp 17 integral with the rear surface of shoulder 13. How the skier makes use of this lever 14 in order to remove his skis is explained hereinafter.

The right-hand articualated arm and jaw are scarcely visible in FIG. 1; however, right-hand jaw 24, comprising ramps 32 and 37, may be seen entering housing 18 in the sole of the boot. This housing 18 is in the form of a substantially trapezoidal aperture passing transversely through the sole of the boot. The dimensions of the jaw are substantially equal to those of the housing, so that the jaw fits into the housing without any play. The planes of contact preferably have a slight slope in order to facilitate fitting and take up any play. The height of the jaw is preferably slightly less than the height of the housing. This arrangement prevents the boot from resting on the articulated arms; instead, the boot rests upon the baseplate, to which it is held by the jaws. Member 19, about which the right-hand articulated arm pivots, may be seen in FIG. 1.

In the example of embodiment illustrated in FIG. 1, the boot has a recess 20 at the back, the recess being designed to allow the boot to turn freely after the release. The geometry of a recess of this kind, and the manner in which it cooperates with the jaws of the binding, have already been described in Patent Application 74,29616 mentioned above. In the present binding, this recess is also used to accomodate the resilient element which actuates the jaws through the transmitting element. The front end of the boot rests upon an anti-friction plate 21, the purpose of which is on the one hand, to serve as a supporting point at the front end of the boot in the event of a release brought about by a forward fall; and on the other hand, to make it easy for the boot to slide when released from the binding, especially under the action of a lateral load.

A description will now be given of the articulated arm and jaws, in conjunction with FIG. 2 which is a view from below of the binding illustrated in FIG. 1, it being assumed that the ski is transparent.

FIG. 2 contains most of the elements described in connection with FIG. 1, namely the ski, baseplate 3 secured to the ski by means of screws such as 2, transmitting element 6 guided, as it moves, by shoulders 7 integral with the baseplate sliding in slots 8, and manually-operated ski-removing lever 14.

Articulated arms 22, 23 are arranged symmetrically in relation to the longitudinal axis of the ski. Each arm has, at its front end, a boot-retaining jaw 24, 25 extending over the upper surface of the baseplate. These articulated arms rotate about vertical pivots 19, 26 which are fixed in relation to transmitting element 6. In this example of embodiment, this axis of rotation consists merely of a pivot pin bearing against a recess in the transmitting element. In the case of more complex or more rugged designs, each pivot pin could be replaced by a member fitted to a hole in the transmitting element. The two pivot pins could also be superimposed or merged. Each articulated arm 22, 23 has a ramp 27, 28 located between the boot-holding jaw and the vertical axis of rotation fixed in relation to the transmitting element. Each ramp 27, 28 slides on a supporting point 29, 30 integral with baseplate 3.

Spring 9 causes the transmitting element to move longitudinally from front to rear, i.e. from the jaw to the supporting point, in the direction of arrow F. The jaws are thus caused to move in the direction of arrow F and, simultaneously, to rotate in the direction of arrows G1 and G2 respectively for the right and left-hand jaws. The position occupied by articulated arm 23 and left-hand jaw 25, after opening, is shown in dotted lines in FIG. 2.

It will be observed that:

on the one hand, axis 26 moves forward under the action of the resilient element and carries along the transmitting element; and on the other hand, the articulated arm pivots, on a vertical axis, about supporting point 30 while sliding thereagainst.

The purpose of hairpin spring 31, located between the two articulated arms, is to keep the arms apart when the transmitting element is pushed forward as the ski is removed voluntarily.

Figure 3:
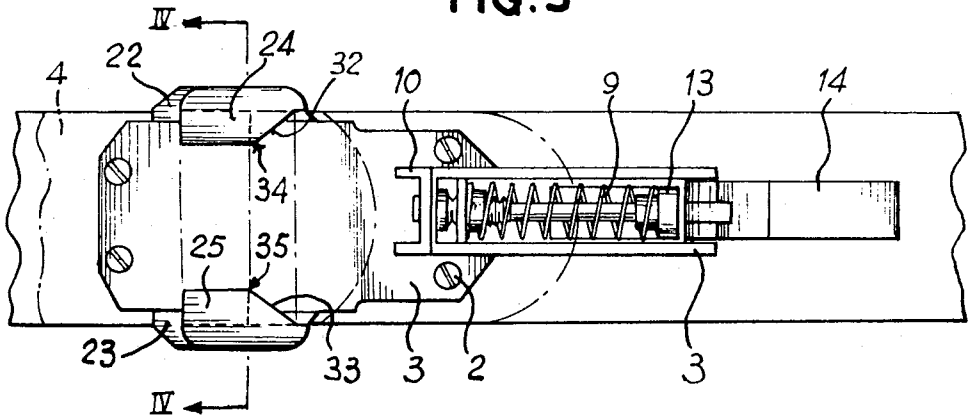
FIG. 3 is a plan view of the binding illustrated in FIG. 1; in this case the boot is assumed to be transparent.

FIG. 3 is a plan view of the binding illustrated in FIG. 1 and contains the elements described in connection with FIGS. 1 and 2.

FIG. 3 makes it possible to show quite clearly the position occupied by jaws 25, 24 cooperating with housing 18 arranged in the sole of the boot on each side. Each jaw has a lateral-release ramp 32, 33 ending in a release nose 34, 35, the function of which will be explained hereinafter.

Figure 4:
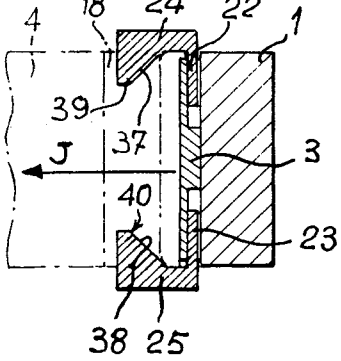
FIG. 4 shows a cross section along the line IV—IV of the binding illustrated in FIG. 1, showing the profile of the jaws.

FIG. 4, which is a cross-section along the line IV—IV of the binding illustrated in FIG. 3, shows ski 1, baseplate 3, articulated arms 22, 23, and jaws 24, 25 entering housing 18 in sole 4 of the boot, in order to secure the boot to the ski. This cross-section makes it possible to show ramps 37, 38 integral with jaws 24, 25 which hold the boot to the ski against the action of a vertical load in the direction of arrow J. The ramps end in two release noses 39, 40, the function of which will be explained hereinafter in describing the action of the binding in response to an abnormally heavy vertical load.

Figure 5:
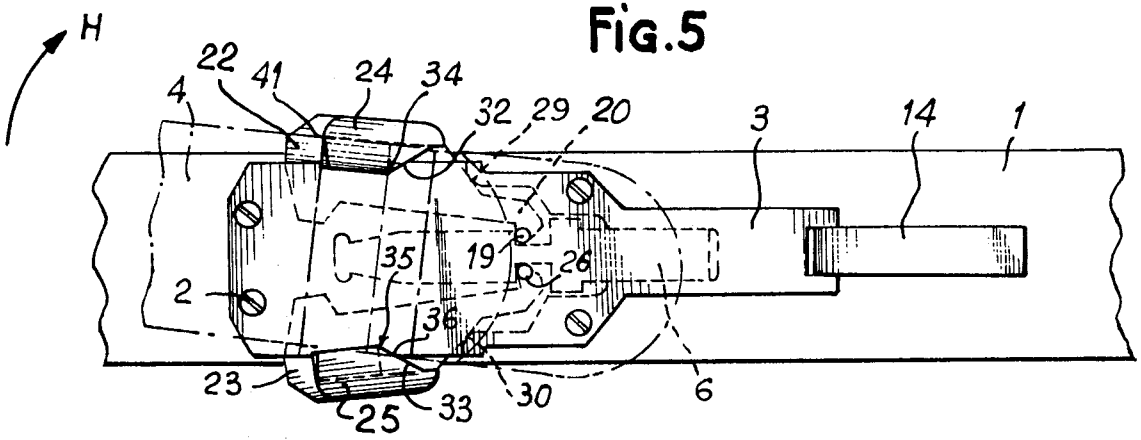
FIG. 5 is a plan view of the binding illustrated in FIG. 1 carrying out a release under the action of a torsion couple.

In conjunction with FIG. 5, and the preceding figures, a description will now be given of the functioning of this example of embodiment of the binding according to the invention.

In response to an abnormally heavy longitudinal load, the boot advances and separates jaws 24, 25 by bearing against ramps 32, 33 on the jaws through sloping ramps 36 (FIG. 1) arranged for this purpose in housing 18 in the sole of the boot. In separating, the articulated arms compress resilient element 9 by means of transmitting element 6, as already described in connection with FIG. 2. As soon as release noses 34, 35 leave housing 18, the boot may freely release itself from the binding.

In response to an abnormally heavy vertical load, the boot pushes back jaws 24, 25 by bearing against ramps 37, 38 integral with the jaws. As soon as release noses 39, 40 (FIG. 4), located at the ends of the ramps, leave the angle at the bottom of ramps 36, 37 in housing 18, the boot is free to release itself from the binding. It should be noted that ramps 36, 37 are rounded off, and the location of the angles cannot therefore be shown in the drawings by a definite point.

In response to an abnormally high torsion couple, the boot tends to pivot in the direction of arrow H (FIG. 5), thus bearing against the front portion of jaw 24 through 41 of housing 18. During this movement, ramp 36 is housing 18, located on the other side of the boot, pushes back jaw 25 by bearing against ramp 33. When release nose 35 leaves housing 18, the boot is free to release itself by continuing to pivot, since recess 20, located under the heel of the boot, is large enough to allow jaw 25 to pass. If the boot is not fitted with this recess 20, it must open jaws 24, 25 much more widely in order to release itself.

A description will now be given of the operation of the voluntary-ski-removal system. When the skier lifts lever 14, nose 16, cooperating with ramp 17, pushes transmitting element 6 back. The arm of the lever is long enough to allow the skier to compress spring 9 without too much effort. When the lever is in the vertical position, flat 42 thereon locks transmitting element 6 in a forward position. The skier may then let go of the lever and stand up, and spring 9 will remain compressed and the transmitting element will remain in the forward position. At this time, the lever arms acted upon by the hairpin spring are automatically separated, and the skier may easily release his boot from the binding. In order to refit his skis, the skier merely lowers the lever, after positioning his boot so that jaws 24, 25 enter housing 18 in the sole of the boot.

Figure 6:
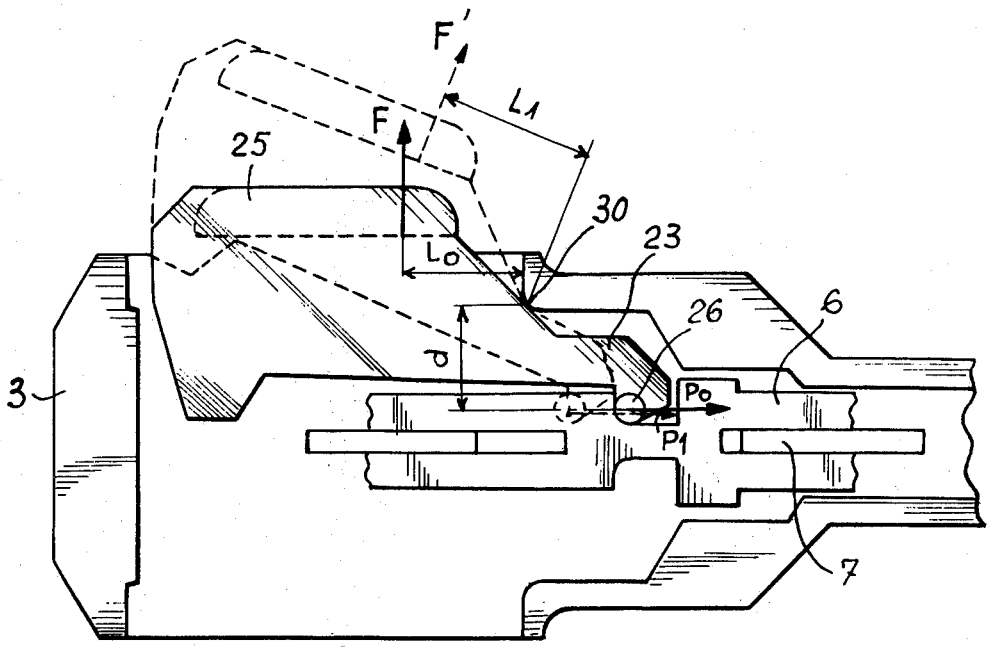
FIG. 6 is a view from below showing details of the positions occupied by an articulated arm before and after the release.

It will now be explained why the binding according to the invention makes it possible to compensate for variations in spring tension, and why this binding operates at an almost constant release load. FIG. 6 is a detail showing the positions occupied by an articulated arm before and after the release. The relationship between lateral release force F, applied by the boot to the jaw, and compression force P, applied by the resilient element, is:

$$F = d/L \times P.$$

wherein:

*d* is the distance between supporting point O for the articulated arm on the baseplate and the direction of the compression force applied by the spring, and

*L* is the distance between this same supporting point O and the direction of the lateral force applied by the boot to the jaw.

Distance *d* constant, whereas distance L is variable, since supporting point O slides along ramp 28 located on the articulated arm. As a result of this, the ratio *d/L* diminishes as the jaw opens, i.e. as the compression force applied by the spring increases. Lateral-release force F, which causes the jaw to open, therefore appears to be the product of the two terms *d/L* and P which decrease and increase respectively as the jaw opens. It is therefore easy to appreciate that lateral-release force F may be kept constant, while the binding is opening, by suitable selection of the mechanical characteristics of the spring and of the ratio *d/L*, especially by profiling ramp 28.

In the example illustrated, the sole of the boot bears against the baseplate of the binding, a solution which is preferable to that of suspending the boot by making the upper horizontal part of housing 18 bear against the upper parts of the jaws. Actually, this situation could occur only if there were no snow under the sole, in which case retention of the boot might well be less satisfactory. Finally, it should be noted that the ramps on the jaws cooperate with housing 18 in such a manner that snow under the sole does not interfere with their operation; and example of such housing is found described in applicant's copending application Ser. No. 689,200 filed May 25, 1976. In this connection, the trapezoidal shape of housing 18, with parallel bases substantially parallel with the plane of the sole, and with the small base arranged at the bottom, is of particular interest.

What is claimed is:

1. A safety binding for a ski boot comprising:

a baseplate adapted to be mounted to a ski;

a supporting element integral with said boot;

two arms pivotally mounted to said baseplate and being arranged symmetrically relative to the longitudinal axis of said ski; each arm including a retaining jaw extending over the plane of said baseplate and cooperating with a lateral edge of said supporting element;

a resilient element mounted on said baseplate;

a movement transmitting element inter-connecting said resilient element and said jaws of said arms;

said resilient element acting through said movement transmitting element to apply said jaws against said supporting element and to allow a safety release of said jaws from said supporting element in the event of an abnormally high load applied by said boot;

said arms rotating about a vertical axis and simultaneously moving longitudinally relative to said baseplate to allow clamping or release of said jaws;

said transmitting element moving longitudinally in relation to the baseplate, each articulated arm:

rotating about a vertical axis which is fixed in relation to the transmitting element, and pivoting slidingly about a supporting point which is fixed in relation to the baseplate and comprising a ramp upon which said supporting slides; said ramp being located between the boot-retaining jaw and said vertical axis of rotation fixed in relation to the transmitting element;

said resilient element being in the form of a spring arranged along the longitudinal axis of the ski:

one end of said spring bearing against a shoulder integral with the baseplate, and the other end of said spring bearing against a shoulder integral with said transmitting element.

2. A safety binding for a ski boot comprising:

a baseplate adapted to be mounted to a ski;

a supporting element integral with said boot;

two arms pivotally mounted to said baseplate and being arranged symmetrically relative to the longitudinal axis of said ski; each arm including a retaining jaw extending over the plane of said baseplate and cooperating with a lateral edge of said supporting element;

a resilient element mounted on said baseplate;

a movement transmitting element inter-connecting said resilient element and said jaws of said arms;

said resilient element acting through said movement transmitting element to apply said jaws against said supporting element and to allow a safety release of said jaws from said supporting element in the event of an abnormally high load applied by said boot;

said arms rotating about a vertical axis and simultaneously moving longitudinally relative to said baseplate to allow clamping or release of said jaws;

said transmitting element moving longitudinally in relation to the baseplate, each articulated arm:

rotating about a vertical axis which is fixed in relation to the transmitting element, and pivoting slidingly about a support point which is fixed in relation to the baseplate and comprising a ramp upon which said supporting point slides; said ramp being located between the boot-retaining jaw and said vertical axis of rotation fixed in relation to the transmitting element; said transmitting element being caused to move longitudinally by the resilient element, in a direction running from the jaw to said supporting point;

said binding further comprising a voluntary-ski-removal element in the form of a lever which is hinged in relation to the baseplate and which cooperates with a ramp integral with the transmitting element, said lever causing said transmitting element to move longitudinally in a direction running from said point of support towards the jaw, and being adapted to move between two positions:

a first position in which:

the transmitting element is locked in relation to the baseplate, the articulated arms are free to pivot and move the jaws away from the boot, a second position in which:

the transmitting element is unlocked and transmits, to the articulated arms and jaws, the force applied by the resilient element.

3. A safety binding for a ski boot, according to claim 2, further comprising a resilient system interposed between the two articulated arms in order to separate said arms automatically during voluntary ski-removal.

4. In combination, a safety binding and a ski boot comprising:

a baseplate adapted to be mounted to a ski;

a supporting element integral with said boot;

two arms pivotally mounted to said baseplate and being arranged symmetrically relative to the longitudinal axis of said ski when mounted thereon; each arm including a retaining jaw extending over the plane of said baseplate and cooperating with a lateral edge of said supporting element;

a resilient element mounted on said baseplate;

a movement transmitting element inter-connecting said resilient element and said jaws of said arms;

said resilient element acting through said movement transmitting element to apply said jaws against said supporting element and to allow a safety release of said jaws from said supporting element in the event of an abnormally high load applied by said boot;

said arms rotating about a vertical axis and simultaneously moving longitudinally relative to said baseplate to allow clamping or release of said jaws;

one end of said boot being provided with a recess which, after release, allows the retaining jaws to pass under the sole of the boot, when said boot pivots in response to a lateral load.

5. A safety binding for a ski boot comprising:

a baseplate adapted to be mounted to a ski;

a supporting element integral with said boot;

two arms pivotally mounted to said baseplate and being arranged symmetrically relative to the longitudinal axis of said ski; each arm including a retaining jaw extending over the plane of said baseplate and cooperating with a lateral edge of said supporting element;

a resilient element mounted on said baseplate;

a movement transmitting element inter-connecting said resilient element and said jaws of said arms;

said resilient element acting through said movement transmitting element to apply said jaws against said supporting element and to allow a safety release of said jaws from said supporting element in the event of an abnormally high load applied by said boot;

said arms about a vertical axis and simultaneously moving longitudinally relative to said baseplate to allow clamping or release of said jaws;

each jaw comprising at least one release ramp ending in a release nose, the supporting element integral with the boot sliding against said ramp; said supporting element integral with the boot including two housings located one on each side thereof, said housings being substantially trapezoidal in cross-section and being adapted to receive therein said ramps.

6. A safety binding for a ski boot, according to claim 5, wherein the small base of the trapezoidal section, substantially parallel with the plane of the sole, is arranged below the large base.

7. A safety binding for a ski boot, according to claim 6, wherein the height of the jaw is less than the height of the cross-sectionally trapezoidal housing in which said jaw engages.

* * * * *